US010641469B2

(12) United States Patent
Lin et al.

(10) Patent No.: US 10,641,469 B2
(45) Date of Patent: May 5, 2020

(54) QUICKLY CLAMPABLE AND DISMOUNTABLE LAMP CONNECTION STRUCTURE

(71) Applicant: Zhongshan Winstar Electrical Co., Ltd., Zhongshan, Guangdong (CN)

(72) Inventors: Wei Bin Lin, Guangdong (CN); Yu Li, Guangdong (CN); Jian Wu Zhu, Guangdong (CN); Zhi Zhuan Liao, Guangdong (CN)

(73) Assignee: Zhongshan Winstar Electrical Co., Ltd., Zhongshan (CN)

( * ) Notice: Subject to any disclaimer, the term of this patent is extended or adjusted under 35 U.S.C. 154(b) by 0 days.

(21) Appl. No.: 16/512,373

(22) Filed: Jul. 16, 2019

(65) Prior Publication Data

US 2020/0063948 A1 Feb. 27, 2020

(30) Foreign Application Priority Data

Aug. 25, 2018 (CN) ..... 2018 1 0976100

(51) Int. Cl.
*F21V 21/04* (2006.01)
*F21V 23/06* (2006.01)
*F21V 21/08* (2006.01)

(52) U.S. Cl.
CPC ..... *F21V 21/046* (2013.01); *F21V 21/0832* (2013.01); *F21V 23/06* (2013.01)

(58) Field of Classification Search
CPC .... F21V 21/046; F21V 23/06; F21V 21/0832; F21V 19/004; F21V 19/003; F21S 8/02; F21S 8/04; F21W 2131/30
See application file for complete search history.

(56) References Cited

U.S. PATENT DOCUMENTS 5,951,145 A * 9/1999 Iwasaki ..... F21S 8/04 362/216
8,382,341 B2 * 2/2013 Peter ..... F21V 21/02 248/343
9,920,912 B1 * 3/2018 Zhang ..... F21V 25/04
10,066,813 B2 * 9/2018 Poorter ..... F21V 23/001

FOREIGN PATENT DOCUMENTS

CN 106151992 A 11/2016
EP 3511607 * 7/2019 ..... F21S 8/04

* cited by examiner

*Primary Examiner* — Peggy A Neils

(57) ABSTRACT

The present invention discloses a quickly clampable and dismountable lamp connection structure, wherein a buckle linkage assembly that fastens the lamp housing body onto the fixed connecting seat in a dismountable manner is arranged between opposite junction surfaces of the fixed connecting seat and the lamp housing body, and comprises a locking groove, a hook that can snap into the locking groove in a resilient manner so that the lamp housing body is fastened on the fixed connecting seat, a linkage part that can stretch out or draw back and move together with the hook, and a guide slope for pushing the linkage part to move when the lamp housing body rotates relative to the fixed connecting seat, thereby driving the hook to retreat and break away from the locking groove.

10 Claims, 9 Drawing Sheets

QUICKLY CLAMPABLE AND DISMOUNTABLE LAMP CONNECTION STRUCTURE

CROSS REFERENCE TO RELATED APPLICATIONS

The present application claims the benefit of Chinese Patent Application No. 201810976100.6 filed on Aug. 25, 2018, the contents of which are incorporated herein by reference in its entirety.

TECHNICAL FIELD

The present invention relates to lamps, particularly to a quickly clampable and dismountable lamp connection structure.

BACKGROUND ART

A lamp mounted on a wall or a ceiling generally comprises a fixed connecting seat and a lamp housing body. During use, the fixed connecting seat is connected to a wall or a ceiling in a fixed manner at first and then the lamp housing body is connected to the fixed connecting seat. For easier connection between the lamp housing body and the fixed connecting seat, typically a clamping structure is arranged between the fixed connecting seat and the lamp housing body. For example, Chinese invention patent application 201610805092.X discloses a ceiling lamp structure, comprising: a top lamp house, a lamp body assembled in the top lamp house and an elastic buckle module disposed on the lamp body. The top lamp house comprises a clamping portion disposed on a circumferential side wall of the top lamp house and fitting with the elastic buckle module; when the lamp body and the top lamp house are assembled, the elastic buckle module is compressed under an external force so that the lamp body and the top lamp house are assembled in an abutted manner; after the assembly between the lamp body and the top lamp house is in place, the external force on the elastic buckle module is released, and the elastic buckle module is reset under an elastic force and fits and is connected in a fixed manner with the clamping portion. During dismounting, a press piece of the elastic buckle module needs to be pushed by two hands separately and simultaneously to slide inwards so that the buckle is disengaged from the clamping portion, and then the lamp body can be dismounted and detached relative to the top lamp house.

However, the foregoing connection structure still has a defect of inconvenience in dismounting, in other words, the dismounting requires two hands to hold and push the lamp body, while it is not easy to dismount large or heavy ceiling lamps.

The present invention is proposed to address the defects in the prior art.

SUMMARY

A technical problem that the present invention intends to solve is to provide a quickly clampable and dismountable lamp connection structure, wherein a buckle connector is arranged between a fixed connecting seat and a lamp housing body, and the lamp housing body can be fastened on the fixed connecting seat through cooperation between a hook and a locking groove without alignment; when the lamp housing body rotates relative to the fixed connecting seat, the lamp housing body pushes a linkage part via a guide slope, thereby driving the hook to move and break away from the locking groove, and achieving separation and dismounting between the lamp housing body and the fixed connecting seat. The present invention has features of concise structure, easy clamping and dismounting, and labor saving.

In order to solve the foregoing technical problem, the present invention provides a quickly clampable and dismountable lamp connection structure, comprising a fixed connecting seat and a lamp housing body, a buckle linkage assembly that fastens the lamp housing body onto the fixed connecting seat in a dismountable manner is arranged between opposite junction surfaces of the fixed connecting seat and the lamp housing body, and comprises a locking groove, a hook that can snap into the locking groove in a resilient manner so that the lamp housing body is fastened on the fixed connecting seat, a linkage part that can stretch out or draw back and move together with the hook, and a guide slope, which is for pushing the linkage part to move when the lamp housing body rotates relative to the fixed connecting seat, thereby driving the hook to retreat and break away from the locking groove so that the lamp housing body can be separated from the fixed connecting seat.

A cavity is arranged on a surface of the lamp housing body opposite to the fixed connecting seat, the hook is arranged on an inner wall of the cavity in a resiliently telescopic manner, the linkage part is arranged at bottom of the cavity in a slidable manner, a boss is arranged on a surface of the fixed connecting seat opposite to the lamp housing body, the guide slope is arranged on a side face of the boss, and the locking groove is arranged on the fixed connecting seat and on a periphery of the boss.

The buckle linkage assembly further comprises a sliding chute on an inner side of the lamp housing body, the hook is slidably connected inside the sliding chute, a locking elastic part for resiliently pressing the hook to stretch out into the cavity is arranged inside the sliding chute, a guide through groove for guiding slide of the linkage part is arranged at bottom of the cavity, and a transmission part that can make the linkage part retreat resiliently towards inside of the guide through groove is arranged between the hook and the linkage part.

Optionally, the transmission part is a leaf spring, or the linkage part is an elastic pin, or a transmission reset spring for resiliently pressing the transmission part is arranged on inner side of the lamp housing body.

In another embodiment, a cavity is arranged on a surface of the fixed connecting seat opposite to the lamp housing body, a boss is arranged on a surface of the lamp housing body opposite to the fixed connecting seat, the guide slope is arranged on a side face of the boss, the locking groove is arranged on a periphery of the boss of the lamp housing body, the hook can stretch into the cavity in a resilient manner, and the linkage part is arranged on the fixed connecting seat in a slidable manner and located inside the cavity.

The buckle linkage assembly further comprises a sliding chute on the fixed connecting seat, the hook is slidably connected inside the sliding chute, a locking elastic part for resiliently pressing the hook to stretch out to outside of the fixed connecting seat is arranged inside the sliding chute, a guide through groove for guiding slide of the linkage part is arranged on the fixed connecting seat, and a transmission part that can make the linkage part retreat resiliently towards inside of the guide through groove is arranged between the hook and the linkage part.

Optionally, the transmission part is a leaf spring, or the linkage part is an elastic pin, or a transmission reset spring for resiliently pressing the transmission part is arranged on the fixed connecting seat.

Preferably, a locking portion adjacent to a central position of the boss and a delocking portion far from the central position of the boss are arranged on the guide slope, a slope is used for smooth transition between the locking portion and delocking portion, the locking portion is used to lock the lamp housing body onto the fixed connecting seat, and the delocking portion is used to separate the lamp housing body from the fixed connecting seat.

A notch or recess is arranged on the delocking portion so that when the lamp housing body rotates relative to the fixed connecting seat, the linkage part will slide from the locking portion to the delocking portion at first and then snap into the notch or recess so that the lamp housing body is unable to continue to rotate relative to the fixed connecting seat, while the hook under push and press of the linkage part will gradually retreat and break away from the locking groove so that the lamp housing body can be dismounted and separated from the fixed connecting seat.

Opposite junction surfaces of the fixed connecting seat and the lamp housing body are connected to a first coupling electrode and a second coupling electrode in a fixed manner respectively, which remain in electrical contacts all the time when the lamp housing body rotates relative to the fixed connecting seat.

Compared with the prior art, a quickly clampable and dismountable lamp connection structure provided by the present invention has following advantages:

1. A lamp housing body can be easily fastened on a fixed connecting seat through cooperation between a hook and a locking groove without alignment; and a linkage part can be resiliently reset under push, so during installation, an operator does not need to deliberately identify an installation direction of the lamp housing body, and during dismounting, the operator only needs to rotate the lamp housing body so that the linkage part is no longer pushed by a boss and can drive a hook via a guide slope to retreat out of a locking groove.
2. A cavity is arranged on the lamp housing body. The cavity can receive the fixed connecting seat so that the lamp housing body is even closer to a ceiling or a wall, facilitating a concise structure and a wider range of illumination.
3. The hook is connected to the linkage part. During dismounting, an operator can rotate the lamp housing body in any way. The guide slope will push and press the linkage part to slide to drive the hook to retreat, and eventually the lamp housing body can be dismounted.
4. A notch or recess is arranged on a delocking portion. When an operator rotates the lamp housing body to the notch or recess, the hook can break away from the locking groove; if the operator further rotates the lamp housing body, the hook will snap into the locking groove again under action of an elastic force to fasten the lamp housing body onto the fixed connecting seat.

BRIEF DESCRIPTION OF THE DRAWING

Embodiments of the present invention will be described below with reference to the accompanying drawings, of which.

DETAILED DESCRIPTION

Figure 1:
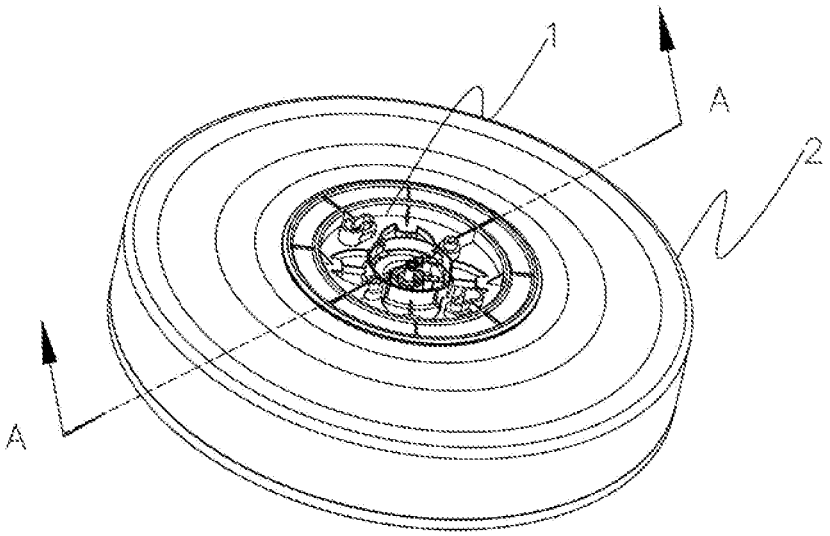
FIG. 1 is a three-dimensional structural schematic view of a first embodiment of a lamp connection structure provided by the present invention.
Figure 2:
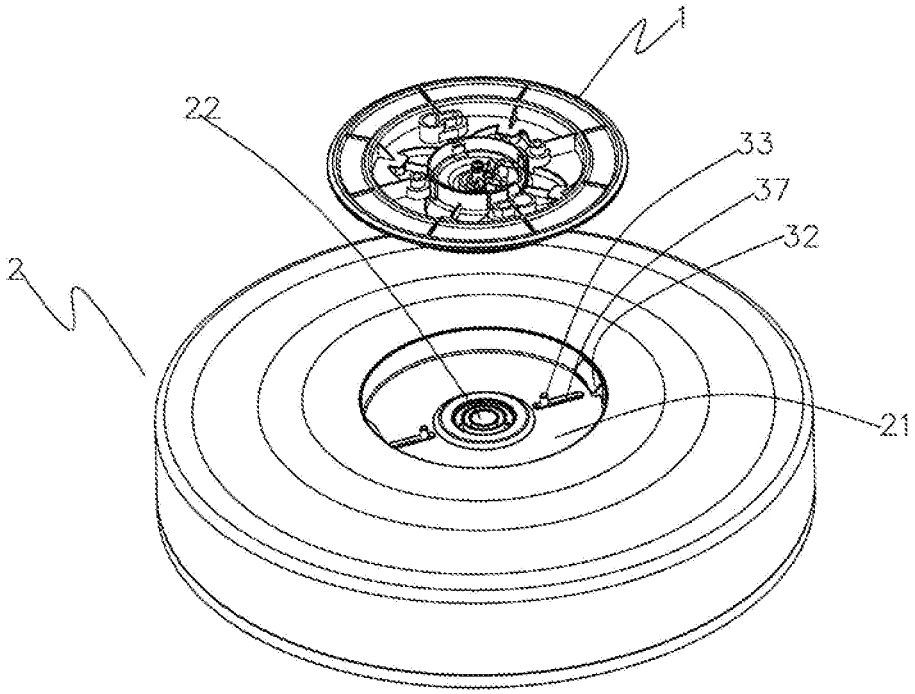
FIG. 2 is a structural schematic view 1 of separation between a fixed connecting seat and a lamp housing body as shown in FIG. 1.
Figure 3:
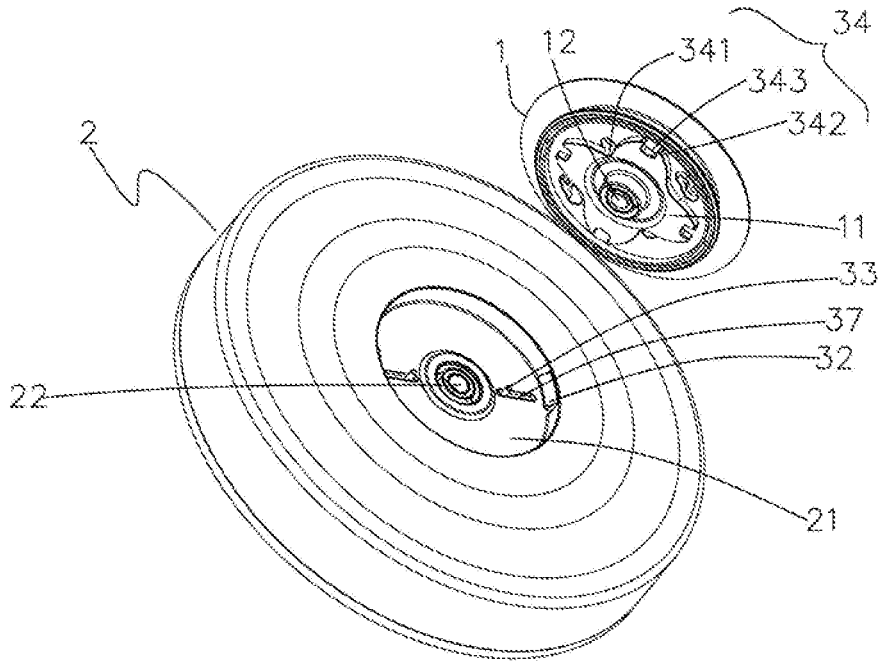
FIG. 3 is a structural schematic view 2 of separation between a fixed connecting seat and a lamp housing body as shown in FIG. 1.
Figure 4:
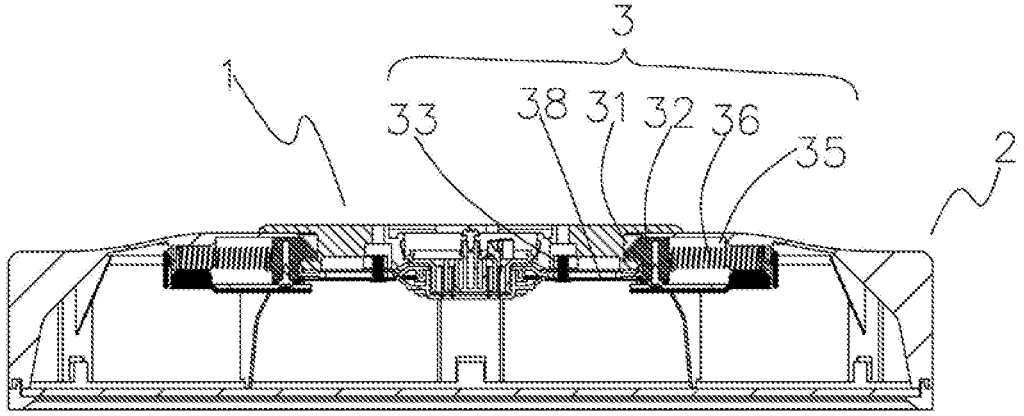
FIG. 4 is an A-A section view of a three-dimensional structure as shown in FIG. 1.

The embodiments of the present invention will be described below with reference to the accompanying drawings.

As shown in FIGS. 1-17, the present invention provides a quickly clampable and dismountable lamp connection structure, comprising a fixed connecting seat 1 and a lamp housing body 2, and a buckle linkage assembly 3 that fastens the lamp housing body 2 onto the fixed connecting seat 1 in a dismountable manner is arranged between opposite junction surfaces of the fixed connecting seat 1 and the lamp housing body 2. The buckle linkage assembly 3 comprises: a locking groove 31; a hook 32 that can snap into the locking groove 31 in a resilient manner so that the lamp housing body 2 is fastened onto the fixed connecting seat 1; a linkage part 33 that can stretch out or draw back and move together with the hook 32; and a guide slope 34, which is for pushing the linkage part 33 to move when the lamp housing body 2 rotates relative to the fixed connecting seat 1, thereby driving the hook 32 to retreat and break away from the locking groove 31 so that the lamp housing body 2 can be separated from the fixed connecting seat. The locking groove 31 in the present invention is an annular groove. When the lamp housing body 2 rotates relative to the fixed connecting seat 1 under an external force, and the linkage part 33 moves to the guide slope 34 side, the guide slope 34 will push the linkage part 33 away from the center to slide outwards and meanwhile drive the hook 32 to retreat until the hook 32 breaks away from the locking groove 31. Now the lamp housing body 2 can be dismounted relative to the fixed connecting seat 1.

Junction surfaces of the fixed connecting seat 1 and the lamp housing body 2 are connected to a first coupling electrode 12 and a second coupling electrode 22 in a fixed manner respectively, which remain in electrical contacts all the time when the lamp housing body 2 rotates relative to the fixed connecting seat 1. Optionally, the first coupling electrode 12 and the second coupling electrode 22 are both in a disc shape. The first coupling electrode 12 and the second coupling electrode 22 adopt plug-in connection, so when the lamp housing body rotates relative to the fixed connecting seat, the first coupling electrode 12 and the second coupling electrode 22 remain in good electrical contacts. When the lamp housing body is dismounted and separated from the fixed connecting seat, the first coupling electrode 12 is separated from the second coupling electrode 22 accordingly.

As shown in FIGS. 1-13, as a first embodiment of the present invention, a cavity 21 is arranged on a surface of the lamp housing body 2 opposite to the fixed connecting seat 1, the hook 32 is arranged on an inner wall of the cavity 21 in a resiliently telescopic manner, the linkage part 33 is arranged at bottom of the cavity 21 in a slidable manner, a boss 11 is arranged on a surface of the fixed connecting seat 1 opposite to the lamp housing body 2, the guide slope 34 is arranged on a side face of the boss 11, and the locking groove 31 is arranged on the fixed connecting seat 1 and on a periphery of the boss 11.

The buckle linkage assembly 3 further comprises a sliding chute 35 on an inner side of the lamp housing body 2, the hook 32 is slidably connected inside the sliding chute 35, a locking elastic part 36 for resiliently pressing the hook 32 to stretch out into the cavity 21 is arranged inside the sliding chute 35, a guide through groove 37 for guiding slide of the linkage part 33 is arranged in an axial direction at bottom of the cavity 21, and a transmission part 38 is arranged between the hook 32 and the linkage part 33.

Figure 10:
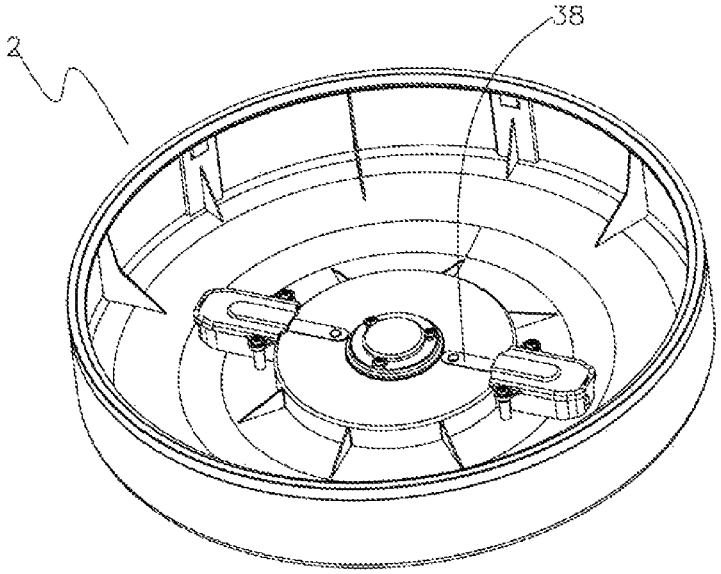
FIG. 10 is a structural schematic view of the interior of a lamp housing body as shown in FIG. 8.
Figure 11:
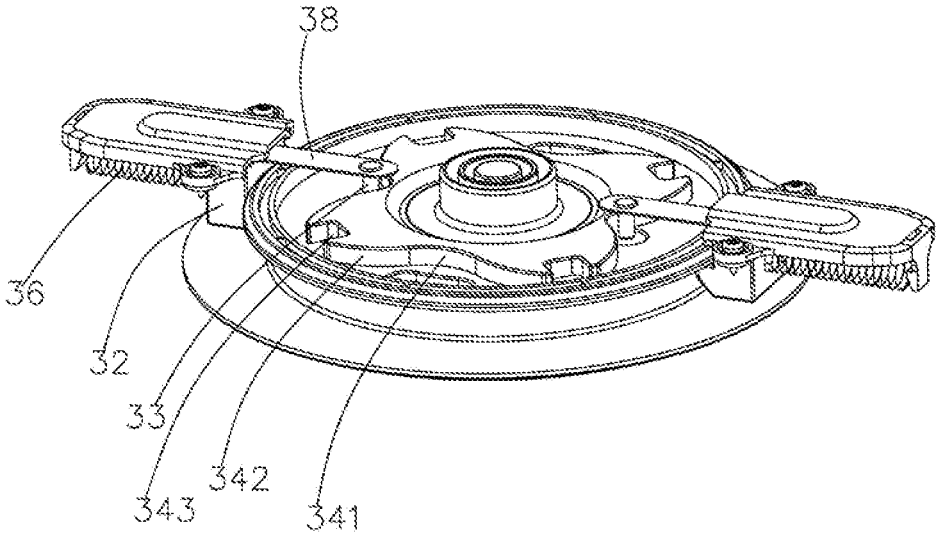
FIG. 11 is a structural schematic view of a buckle linkage assembly of a lamp connection structure as shown in FIG. 1 in a clamped state.
Figure 12:
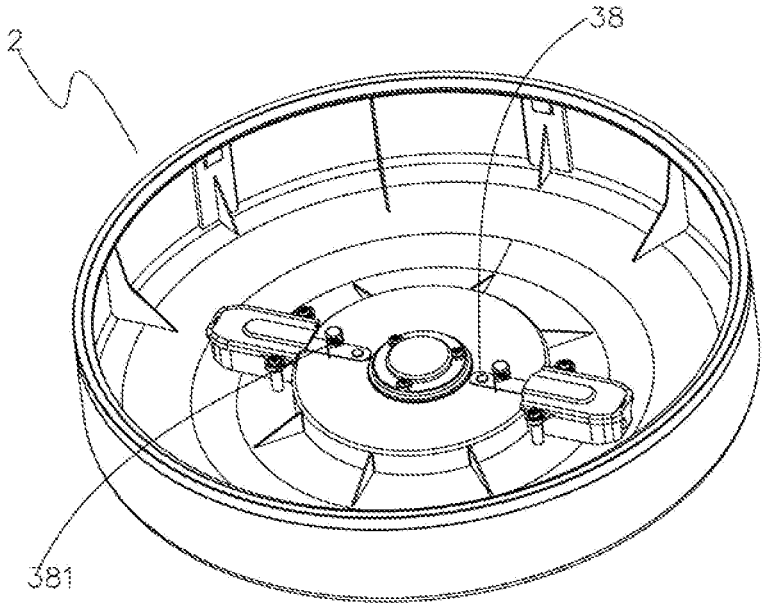
FIG. 12 is a structural schematic view of a buckle linkage assembly with a transmission reset spring as shown in FIG. 1.
Figure 13:
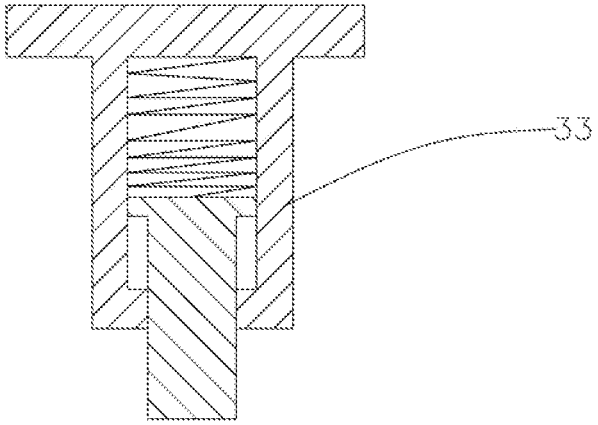
FIG. 13 is a section view of a linkage part, which is an elastic pin, in a buckle linkage assembly as shown in FIG. 1.
Figure 14:
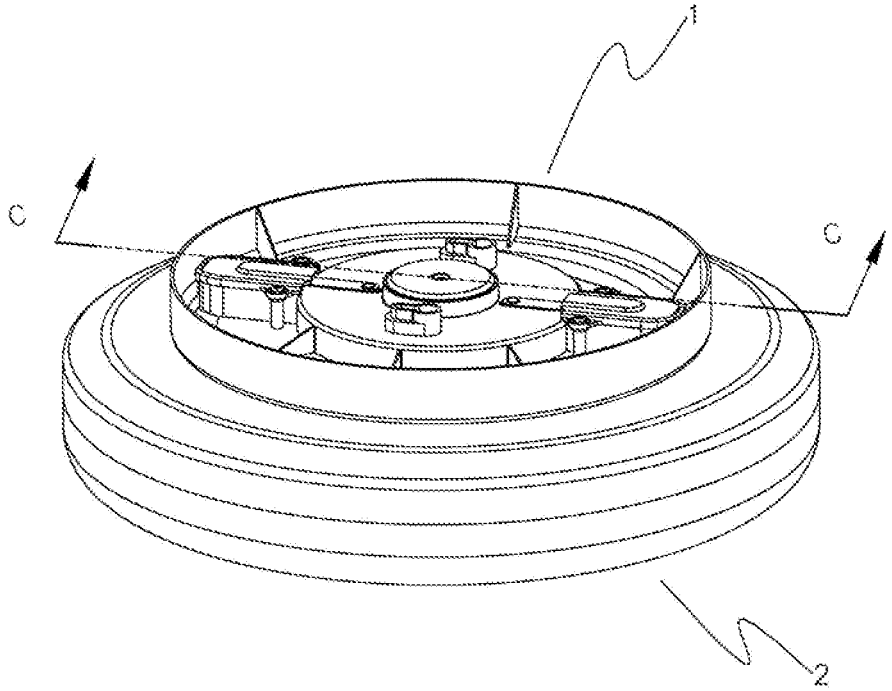
FIG. 14 is a three-dimensional structural schematic view of a second embodiment of the present invention.
Figure 15:
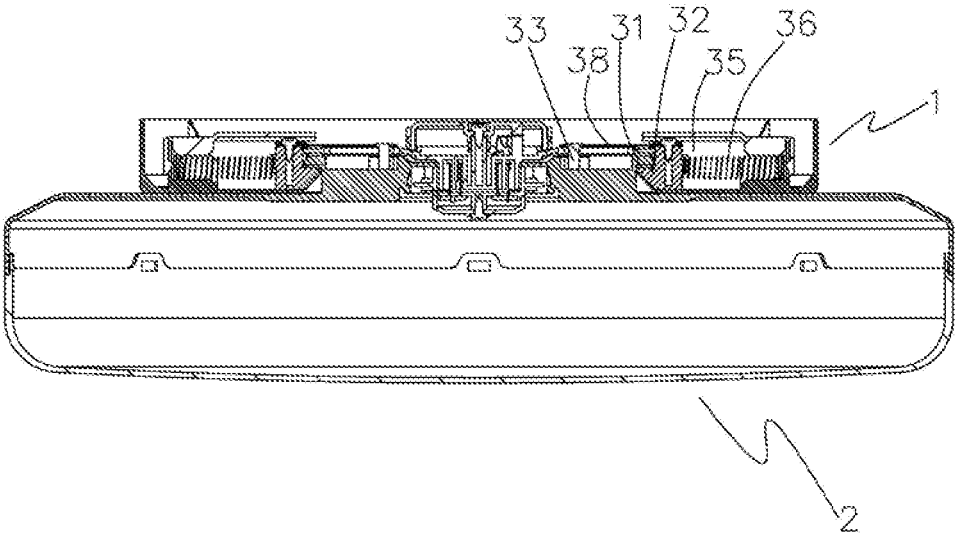
FIG. 15 is a C-C section view of a three-dimensional structure as shown in FIG. 14.
Figure 16:
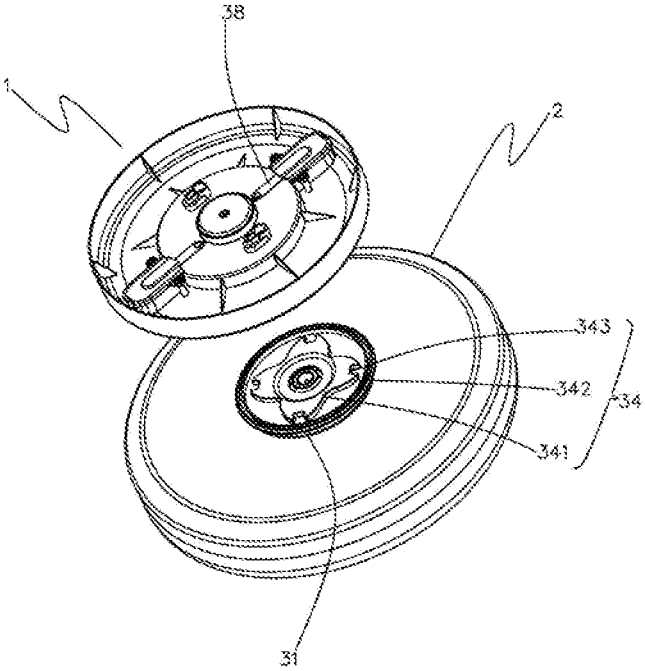
FIG. 16 is a structural schematic view 1 of separation between a fixed connecting seat and a lamp housing body as shown in FIG. 14.
Figure 17:
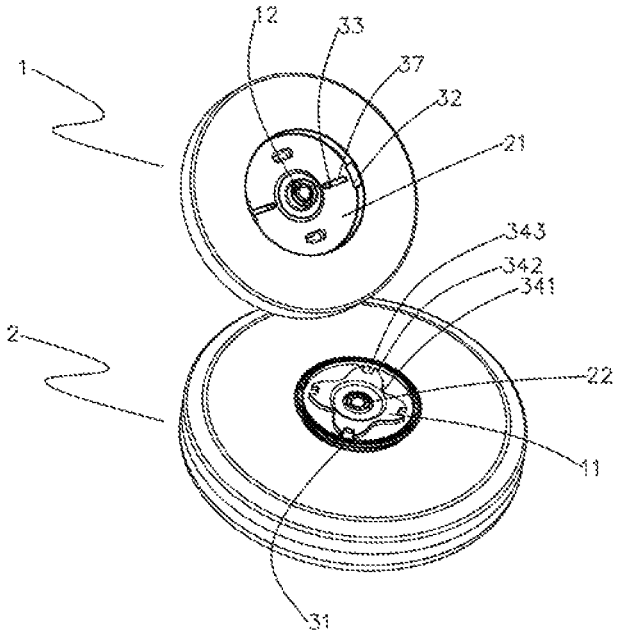
FIG. 17 is a structural schematic view 2 of separation between a fixed connecting seat and a lamp housing body as shown in FIG. 14.

FIGS. 10, 12 and 13 show three elastic avoidance structure solutions, which enable the linkage part 33 to retreat towards inside of the guide through groove 37 in a resilient manner. As shown in FIG. 10, the transmission part 38 in the present invention preferably is a leaf spring. During buckle connection, when the linkage part 33 is pushed and pressed by a surface of the boss, the transmission part 38 will generate elastic deformation, and an external end of the linkage part 33 will retreat into the guide through groove 37 and continue to rotate the lamp housing body 2. When the linkage part 33 moves to the guide slope side of the boss or is already on the guide slope side, the transmission part 38 will be reset in a resilient manner, and the linkage part 33 will stretch out and pass through the guide through groove 37. If the lamp housing body 2 continues to rotate, the guide slope 34 will push the linkage part 33, and the transmission part 38 will drive the hook to retreat out of the locking groove 31.

As shown in FIG. 13, the linkage part 33 is an elastic pin, and one end of the elastic pin is an elastic end that is telescopic in a resilient manner. When the linkage part 33 is pressed by a surface of the boss, the elastic end of the linkage part 33 will retreat into the guide through groove 37 and continue to rotate the lamp housing body 2. When the linkage part 33 slides down to the guide slope 34 side of the boss, the elastic end of the linkage part 33 will stretch out and pass through the guide through groove 37. If the lamp housing body 2 continues to rotate, the guide slope 34 will push and press the linkage part 33, and the transmission part 38 will drive the hook 32 to retreat out of the locking groove 31.

As shown in FIG. 12, a transmission reset spring 381 for resiliently pressing the transmission part 38 may be arranged on inner side of the lamp housing body 2. When the linkage part 33 is pressed by a surface of the boss, the linkage part 33 will press the transmission part 38, the transmission part 38 will then compress the transmission reset spring 381, and an end of the linkage part 33 will retreat into the guide through groove 37 and continue to rotate the lamp housing body 2. When the linkage part 33 moves to the guide slope side of the boss, the guide slope 34 will push and press the linkage part 33, and the hook 32 under drive of the transmission part 38 will retreat into the locking groove 31.

As shown in FIGS. 14-17, as a second embodiment of the present invention, a cavity 21 is arranged on a surface of the fixed connecting seat lopposite to the lamp housing body 2, a boss 11 is arranged on a surface of the lamp housing body 2 opposite to the fixed connecting seat 1, the fixed connecting seat 1 is connected to the lamp housing body 2 via the cavity 21 so that the lamp housing body 2 is even closer to a wall surface or a ceiling, a range of illumination is larger and the boss on the lamp housing body 2 can be concealed. The guide slope 34 is arranged on a side face of the boss 11, the locking groove 31 is arranged on a periphery of the boss 11 of the lamp housing body 2, the locking groove 31 is an annular groove, the hook 32 can stretch into the cavity 21 in a resilient manner, and the linkage part 33 is arranged on the fixed connecting seat 1 in a slidable manner and located inside the cavity 21.

The buckle linkage assembly 3 further comprises a sliding chute 35 on the fixed connecting seat 1, the hook 32 is connected to inside of the sliding chute 35 in a slidable manner, a locking elastic part 36 for resiliently pressing the hook 32 to stretch out to outside of the fixed connecting seat 1 is arranged inside the sliding chute 35, a guide through groove 37 for guiding slide of the linkage part 33 is arranged on the fixed connecting seat 1, and a transmission part 38 is arranged between the hook 32 and the linkage part 33. In order that the linkage part can resiliently retreat into the guide through groove when pushed and pressed by a surface of the boss, the transmission part 38 is a leaf spring, or the linkage part 33 is an elastic pin, or a transmission reset spring 381 for resiliently pressing the transmission part 38 is arranged on the fixed connecting seat 1. The foregoing three elastic avoidance structure solutions are same as the corresponding three elastic avoidance structure solutions in the first embodiment in terms of working principle.

Figure 5:
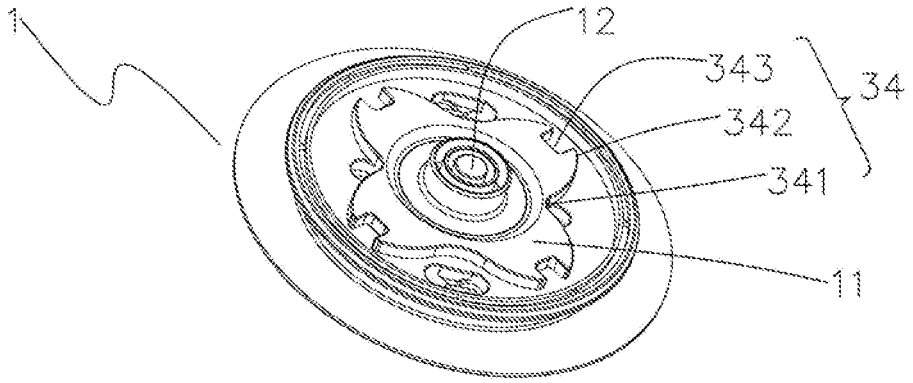
FIG. 5 is a structural schematic view of a boss of a fixed connecting seat as shown in FIG. 1.

A locking portion 341 adjacent to a central position of the boss 11 and a delocking portion 342 far from the central position of the boss 11 are arranged on the guide slope 34 of the buckle linkage assembly 3 in the present invention, and a slope is used for smooth transition between the locking portion 341 and the delocking portion 342. The delocking portion 342 of the guide slope 34 can be set in different shapes, for example, without limitation, following few shapes:

As shown in FIG. 5, a notch 343 is arranged on the delocking portion 342. When the lamp housing body 2 rotates relative to the fixed connecting seat 1, the linkage part 33 will slide from the locking portion 341 to the delocking portion 342 at first and then snap into the notch 343 so that the lamp housing body 2 is unable to continue to rotate relative to the fixed connecting seat 1, while the hook 32 under push of the linkage part 33 will gradually retreat and break away from the locking groove 31 so that the lamp housing body 2 is separated from the fixed connecting seat 1 and can be dismounted.

Figure 6:
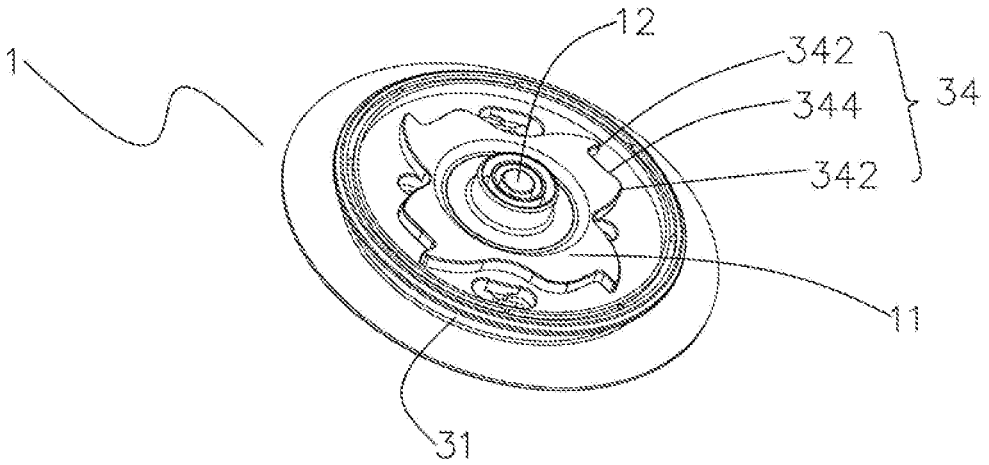
FIG. 6 is a structural schematic view of a modification of a boss of a fixed connecting seat as shown in FIG. 1.
Figure 7:
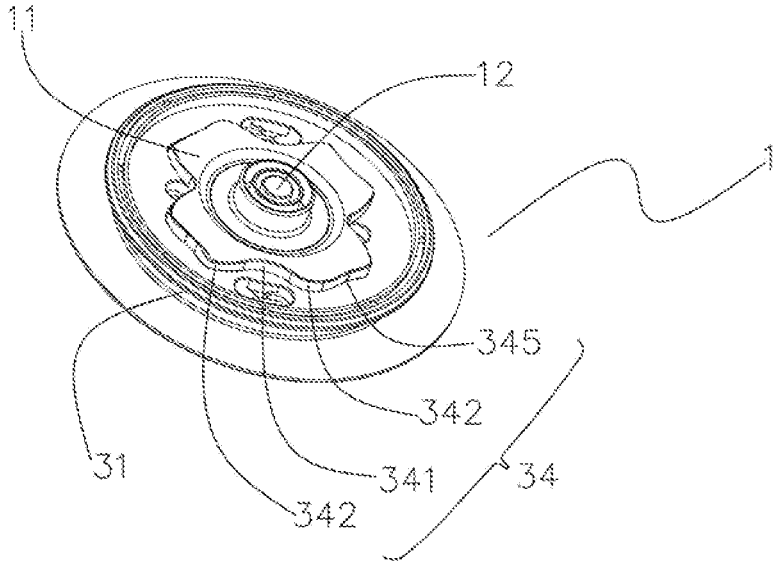
FIG. 7 is a structural schematic view of another modification of a boss of a fixed connecting seat as shown in FIG. 1.
Figure 8:
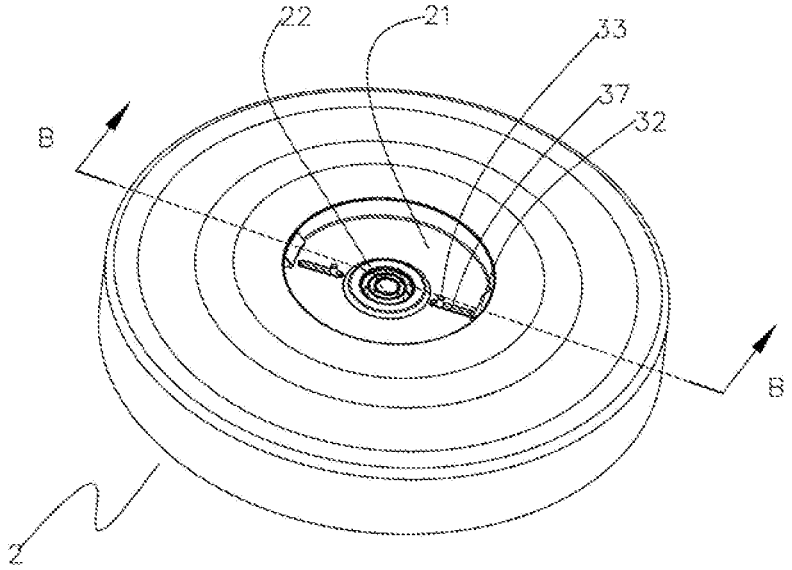
FIG. 8 is a structural schematic view of a lamp housing body as shown in FIG. 1.
Figure 9:
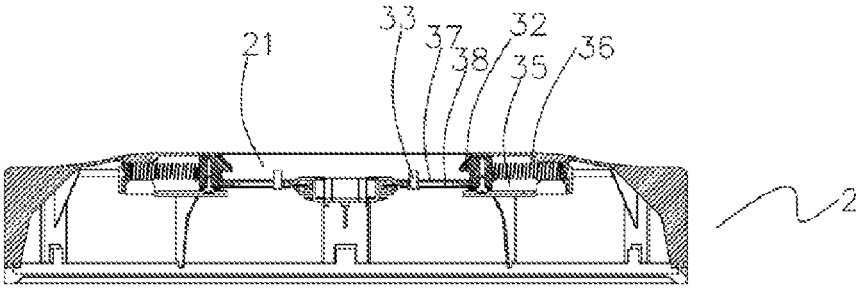
FIG. 9 is a B-B section view of a lamp housing body as shown in FIG. 8.

Recesses in different shapes can be arranged on the delocking portion 342 of the guide slope 34 to replace the notch 343. A recess 344 is shown in FIG. 6 and a recess 345 is shown in FIG. 7.

Likewise, when the lamp housing body 2 rotates relative to the fixed connecting seat 1, the linkage part 33 will slide from the locking portion 341 to the delocking portion 342 at first and then to recesses 344 & 345. Now, the hook 32 has retreated and broken away from the locking groove 31 under push of the linkage part 33, and the lamp housing body 2 can be dismounted and separated from the fixed connecting seat 1. If the lamp housing body 2 continues to rotate in the same direction, when the linkage part 33 slides to the locking portion 341, the linkage part 33 acts on the hook 32 via the transmission part 38. The hook 32 will stretch out and snap into the locking groove 31 to fasten and lock the lamp housing body 2 onto the fixed connecting seat 1 again.

When the present invention adopts the foregoing technical solution for installation and fastening, no deliberate alignment is needed. The lamp housing body 2 is directly pushed and pressed towards the direction of the fixed connecting seat 1, and the hook 32 will snap into the locking groove 31. Hence, the buckling connection between the lamp housing body 2 and the fixed connecting seat 1 is completed. During the buckling connection, there will be two circumstances. The first circumstance: The linkage part 33 is at the locking portion 341 of the guide slope 34 by accident. In this case, when the lamp housing body 2 is rotated, the guide slope 34 will push and press the linkage part 33 and act on the hook 32 via the transmission part 38 to make the hook 32 retreat into the locking groove 31. The second circumstance: the linkage part 33 is pushed and pressed by a surface of the boss 11, and retreats into the guide through groove 37. When the lamp housing body 2 continues to rotate, and the linkage part 33 moves to the locking portion 341 of the guide slope 34 of the boss 11, the linkage part 33 will stretch out and pass through the guide through groove 37. If the lamp housing body 2 rotates again, the linkage part 33 will slide from the locking portion 341 to the delocking portion 342. The guide slope 34 is pushed and pressed by the guide slope 34, and the transmission part 38 drives the hook 32 to retreat out of the locking groove 31.

What is claimed is:

1. A quickly clampable and dismountable lamp connection structure, wherein the structure comprises a fixed connecting seat and a lamp housing body, and a buckle linkage assembly that fastens the lamp housing body onto the fixed connecting seat in a dismountable manner is arranged between opposite junction surfaces of the fixed connecting seat and the lamp housing body, wherein the buckle linkage assembly comprises a locking groove, a hook that can snap into the locking groove in a resilient manner so that the lamp housing body is fastened onto the fixed connecting seat, a linkage part that can stretch out or draw back and move together with the hook, and a guide slope, which is for pushing the linkage part to move when the lamp housing body rotates relative to the fixed connecting seat, thereby driving the hook to retreat and break away from the locking groove so that the lamp housing body can be separated from the fixed connecting seat.

2. The lamp connection structure according to claim 1, wherein a cavity is arranged on a surface of the lamp housing body opposite to the fixed connecting seat, the hook is arranged on an inner wall of the cavity in a resiliently telescopic manner, the linkage part is arranged at bottom of the cavity in a slidable manner, a boss is arranged on a surface of the fixed connecting seat opposite to the lamp housing body, the guide slope is arranged on a side face of the boss, and the locking groove is arranged on the fixed connecting seat and on a periphery of the boss.

3. The lamp connection structure according to claim 2, wherein the buckle linkage assembly further comprises a sliding chute on an inner side of the lamp housing body, the hook is slidably connected inside the sliding chute, a locking elastic part for resiliently pressing the hook to stretch into the cavity is arranged inside the sliding chute, a guide through groove for guiding slide of the linkage part is arranged at bottom of the cavity, and a transmission part is arranged between the hook and the linkage part.

4. The lamp connection structure according to claim 3, wherein the transmission part is a leaf spring, or the linkage part is an elastic pin, or a transmission reset spring for resiliently pressing the transmission part is arranged on inner side of the lamp housing body.

5. The lamp connection structure according to claim 1, wherein a cavity is arranged on a surface of the fixed connecting seat opposite to the lamp housing body, a boss is arranged on a surface of the lamp housing body opposite to the fixed connecting seat, the guide slope is arranged on a side face of the boss, the locking groove is arranged on a periphery of the boss of the lamp housing body, the hook can stretch into the cavity in a resilient manner, and the linkage part is arranged on the fixed connecting seat in a slidable manner and located inside the cavity.

6. The lamp connection structure according to claim 5, wherein the buckle linkage assembly further comprises a sliding chute on the fixed connecting seat, the hook is slidably connected inside the sliding chute, a locking elastic part for resiliently pressing the hook to stretch into the cavity is arranged inside the sliding chute, a guide through groove for guiding slide of the linkage part is arranged on the fixed connecting seat, and a transmission part is arranged between the hook and the linkage part.

7. The lamp connection structure according to claim 6, wherein the transmission part is a leaf spring, or the linkage part is an elastic pin, or a transmission reset spring for resiliently pressing the transmission part is arranged on inner side of the lamp housing body.

8. The lamp connection structure according to claim 1, wherein a locking portion adjacent to a central position of the boss and a delocking portion far from the central position of the boss are arranged on the guide slope, a slope is used for smooth transition between the locking portion and delocking portion, the locking portion is used to lock the lamp housing body onto the fixed connecting seat, and the delocking portion is used to separate the lamp housing body from the fixed connecting seat.

9. The lamp connection structure according to claim 8, wherein a notch or recess is arranged on the delocking portion so that when the lamp housing body rotates relative to the fixed connecting seat, the linkage part will slide from the locking portion to the delocking portion at first and then snap into the notch or recess so that the lamp housing body is unable to continue to rotate relative to the fixed connecting seat, while the hook under push of the linkage part will gradually retreat and break away from the locking groove so that the lamp housing body can be dismounted and separated from the fixed connecting seat.

10. The lamp connection structure according to claim 1, wherein opposite junction surfaces of the fixed connecting seat and the lamp housing body are connected to a first coupling electrode and a second coupling electrode in a fixed manner respectively, which remain in electrical contacts all the time when the lamp housing body rotates relative to the fixed connecting seat.

* * * * *